US010334355B2

(12) United States Patent
Johnson et al.

(10) Patent No.: US 10,334,355 B2
(45) Date of Patent: Jun. 25, 2019

(54) MULTI-DRIVER ACOUSTIC HORN FOR HORIZONTAL BEAM CONTROL

(71) Applicant: Apple Inc., Cupertino, CA (US)

(72) Inventors: Martin E. Johnson, Los Gatos, CA (US); Christopher Wilk, Los Gatos, CA (US); John H. Sheerin, Santa Clara, CA (US); Suzanne Hardy, San Jose, CA (US); Tom-Davy William Jendrik Saux, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/514,815

(22) PCT Filed: Sep. 29, 2015

(86) PCT No.: PCT/US2015/053024
§ 371 (c)(1),
(2) Date: Mar. 27, 2017

(87) PCT Pub. No.: WO2016/054099
PCT Pub. Date: Apr. 7, 2016

(65) Prior Publication Data

US 2017/0223447 A1 Aug. 3, 2017

Related U.S. Application Data

(60) Provisional application No. 62/057,982, filed on Sep. 30, 2014.

(51) Int. Cl.
*H04R 9/06* (2006.01)
*H04R 1/30* (2006.01)
(Continued)

(52) U.S. Cl.
CPC ..... *H04R 1/30* (2013.01); *H04R 1/2807* (2013.01); *H04R 1/323* (2013.01); *H04R 1/326* (2013.01);
(Continued)

(58) Field of Classification Search
CPC ..... H04R 1/02; H04R 1/30; H04R 1/2861; H04R 1/2865; H04R 1/00; H04R 2205/022; H04R 2201/401; H04R 2201/405
(Continued)

(56) References Cited

U.S. PATENT DOCUMENTS 2,976,373 A 3/1961 Uchida
4,227,051 A * 10/1980 Thomas ..... H04R 1/24 381/346
(Continued)

FOREIGN PATENT DOCUMENTS

EP 0252337 A2 1/1988
EP 3130157 A1 2/2017
(Continued)

OTHER PUBLICATIONS

PCT International Search Report and Written Opinion for PCT International Appin No. PCT/US2015/053024 dated Dec. 10, 2015 (10 pages).
(Continued)

*Primary Examiner* — Suhan Ni
(74) *Attorney, Agent, or Firm* — Womble Bond Dickinson (US) LLP

(57) ABSTRACT

A loudspeaker array has a cabinet in which is formed a continuously open circumferential horn for controlling sound produced by a number of transducers which are positioned in the cabinet, at a throat of the horn. The continuously open circumferential horn may 1) improve the
(Continued)

power efficiency of the transducers without unwanted aliasing effects in audible frequency ranges and 2) provide vertical control for sound emitted by the transducers by flaring.

19 Claims, 15 Drawing Sheets

(51) Int. Cl.
*H04R 1/40* (2006.01)
*H04R 1/28* (2006.01)
*H04R 1/32* (2006.01)
*H04R 1/26* (2006.01)

(52) U.S. Cl.
CPC ..... *H04R 1/403* (2013.01); *H04R 1/26* (2013.01); *H04R 2201/401* (2013.01)

(58) Field of Classification Search
USPC ..... 381/332, 334–336, 340–342, 182
See application file for complete search history.

(56) References Cited

U.S. PATENT DOCUMENTS

| | | | | |
|---|---|---|---|---|
| 4,496,021 | A | 1/1985 | Berlant | |
| 4,796,009 | A * | 1/1989 | Biersach | G10K 9/13 381/342 |
| 6,394,223 | B1 | 5/2002 | Lehman | |
| 7,426,278 | B2 * | 9/2008 | Meynial | H04R 1/403 381/182 |
| 8,111,585 | B1 * | 2/2012 | Graber | G01S 7/521 367/151 |
| 8,223,592 | B2 * | 7/2012 | Graber | G10K 11/24 381/182 |
| 2010/0119090 | A1 | 5/2010 | Graber | |
| 2011/0064247 | A1 | 3/2011 | Ickler | |
| 2012/0213387 | A1 | 8/2012 | Blore et al. | |

FOREIGN PATENT DOCUMENTS

| | | | |
|---|---|---|---|
| WO | WO/94/19915 | A1 | 9/1994 |
| WO | WO2007044223 | A2 | 4/2007 |
| WO | WO2015157260 | A1 | 10/2015 |

OTHER PUBLICATIONS

PCT International Preliminary Report on Patentability for PCT/US2015/053024, dated Apr. 13, 2017.
Chinese Office Action dated Mar. 5, 2019 for related Chinese Appln. No. 201580064345.6 15 Pages.
European Office Action dated Mar. 29, 2019 for related European Appln. No. 15778539.5 6 Pages.

* cited by examiner

MULTI-DRIVER ACOUSTIC HORN FOR HORIZONTAL BEAM CONTROL

This application is a U.S. National Phase Application under 35 U.S.C. § 371 of International Application No. PCT/US2015/053024, filed Sep. 29, 2015, which claims the benefit of U.S. Provisional Patent Application No. 62/057,982, filed Sep. 30, 2014, and this application hereby incorporates herein by reference that provisional patent application.

FIELD

A loudspeaker array is disclosed with a continuously open circumferential horn that provides improved gain, directional sound control, and reduced spurious beams or sidelobes (that are typically generated above an aliasing frequency such that the generated beam is no longer well controlled.) Other embodiments are also described.

BACKGROUND

Loudspeaker arrays are often used by computers and home electronics for outputting sound into a listening area. Each loudspeaker array may be composed of multiple transducers that are arranged on a single plane or surface of an associated cabinet or casing. Acoustic horns may be used along with transducers to increase the efficiency by which these transducers output sound. In particular, horns may provide (1) extra acoustic gain in one or more frequency bands and (2) directivity control.

Although horns may provide some efficiency improvements, horns may also lead to aliasing issues between transducers. In particular, horns may increase the distance between the points where sound from adjacent transducers in a loudspeaker array is mixed. This distance defines the aliasing frequency above which sound may become distorted based on sound mixing between proximate transducers.

Further, traditional horn designs suffer from sharp cutoff frequencies caused by the shape and dimensions of the horn. Accordingly, sound produced by a transducer below this frequency is cut off or inconsistently modified in comparison to higher frequency content.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

An audio system operating within a listening area is described herein. The audio system may include an audio receiver and a loudspeaker array. The audio receiver may be coupled to the loudspeaker array to drive individual transducers in the loudspeaker array to emit various sound beam or radiation patterns into the listening area for a listener. In one embodiment, the loudspeaker array may include a continuously open circumferential horn for controlling sound produced by the transducers. In this embodiment, one or more transducers may be coupled proximate to a throat of the horn. The continuously open circumferential horn may 1) improve the power efficiency of the transducers without unwanted aliasing effects in audible frequency ranges and/or 2) provide vertical control for sound emitted by the transducers.

In particular, by providing an unobstructed and open cavity for sound emitted by the transducers to mix, the continuously open circumferential horn may decrease a mixing distance between adjacent transducers (e.g., transducers that are directly adjacent in the ring of transducers) such that a corresponding aliasing frequency is increased. This aliasing frequency describes the highest frequency that may be emitted by the transducers without generation or production of aliasing effects caused by mixing of sound between transducers. Accordingly, by decreasing the mixing distance, the continuously open circumferential horn increases the maximum frequency that may be produced by the transducers without unwanted effects.

Further, the continuously open circumferential horn may provide improved directional control for sound produced by the transducers, including both horizontal and vertical control. For example, the outer corners of the continuously open circumferential horn may be curved. These curved corners more uniformly improve gain across frequency ranges in comparison to horns that are abruptly cutoff at the mouth of the horn.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
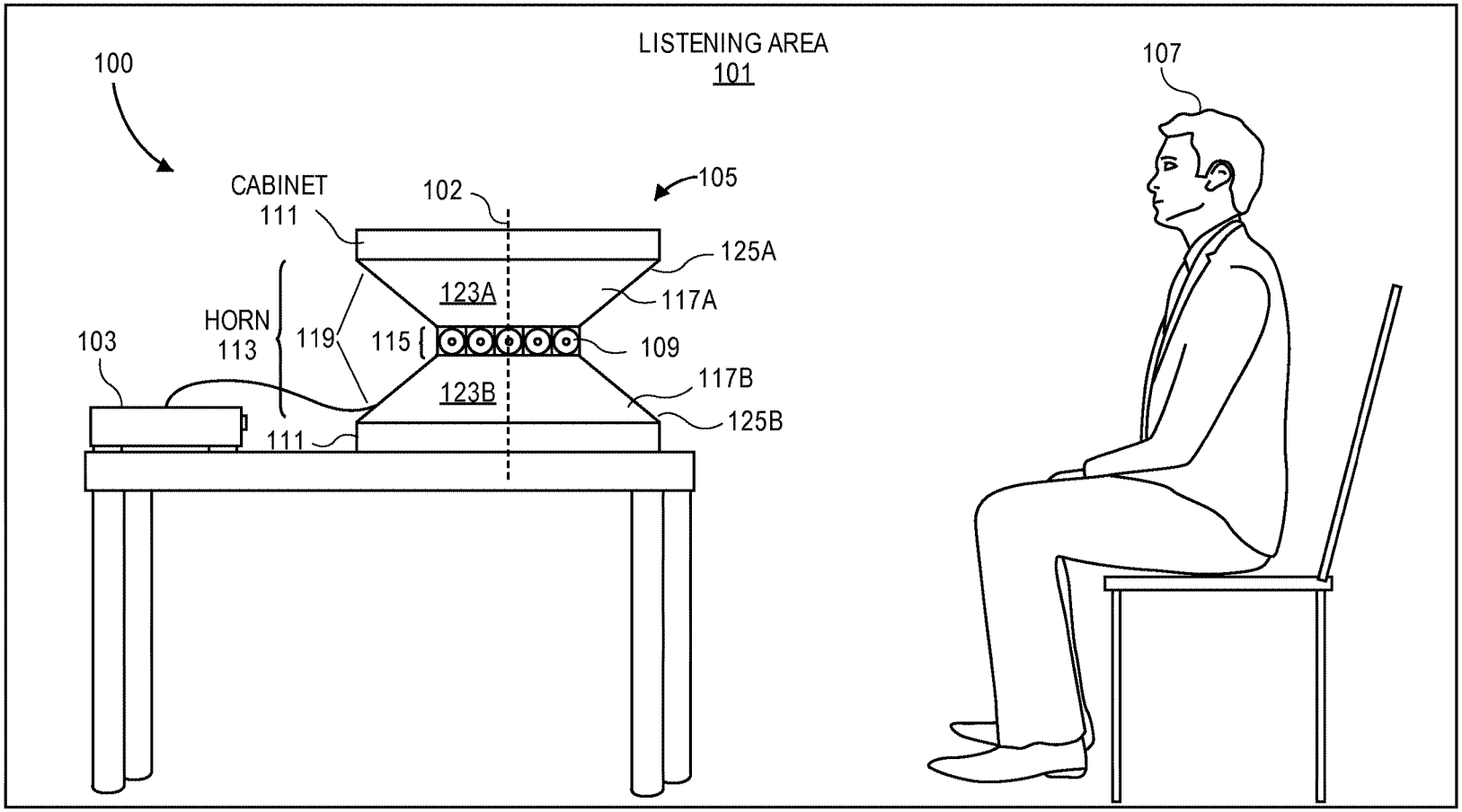
FIG. 1 shows a view of a listening area with an audio receiver, a loudspeaker array, and a listener according to one embodiment.

FIG. 1 shows a view of an audio system 100 operating within a listening area 101 according to one embodiment. The audio system 100 may include an audio receiver 103 and a loudspeaker array 105. The audio receiver 103 may be coupled to the loudspeaker array 105 to drive individual transducers 109 in the loudspeaker array 105 to emit various sound beam/radiation patterns into the listening area 101 for a listener 107. In one embodiment, the loudspeaker array 105 may include a continuously open circumferential horn 113 for controlling sound produced by the transducers 109. In this embodiment, one or more transducers 109 may be coupled proximate to a throat 115 of the horn 113. As will be described in greater detail below, the continuously open circumferential horn 113 may 1) improve the power efficiency of the transducers 109 without unwanted aliasing effects in audible frequency ranges and/or 2) provide vertical control for sound emitted by the transducers 109.

In some embodiments, the transducers 109 of the array 105 may be configured to generate beam patterns. The beam patterns may represent individual channels of a piece of sound program content. For example, the loudspeaker array 105 may generate beam patterns that represent front left, front right, and front center channels for a piece of sound program content (e.g., a musical composition or an audio track for a movie).

Each element of the audio system 100 shown in FIG. 1 will be described below by way of example. In other embodiments, the audio system 100 may include additional components than those described below and shown in FIG. 1.

Figure 2:
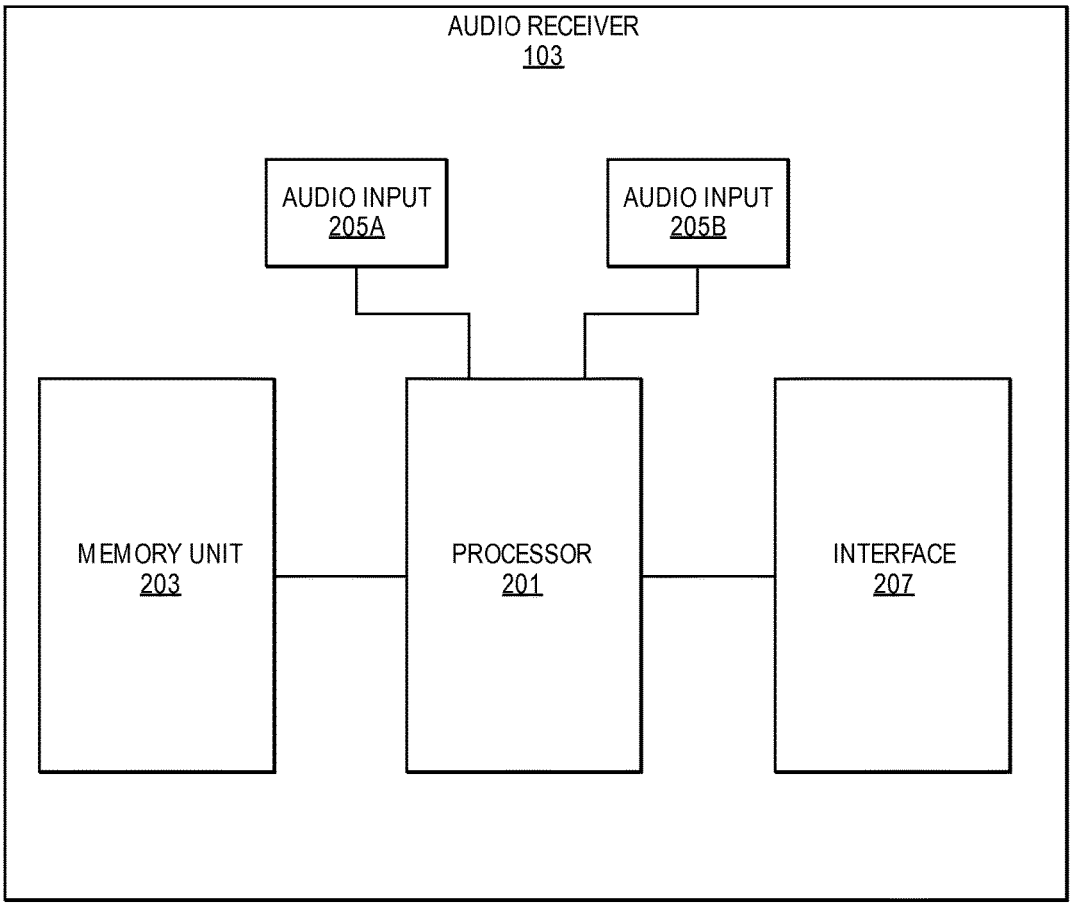
FIG. 2 shows a component diagram of the audio receiver according to one embodiment.

FIG. 2 shows a component diagram of the audio receiver 103 according to one embodiment. The audio receiver 103 may be any electronic device that is capable of driving one or more transducers 109 in the loudspeaker array 105. For example, the audio receiver 103 may be a desktop computer, a laptop computer, a tablet computer, a home theater receiver, a set-top box, and/or a mobile device (e.g., a smartphone). The audio receiver 103 may include a hardware processor 201 and a memory unit 203.

The processor 201 and the memory unit 203 are used here to refer to any suitable combination of programmable data processing components and data storage that conduct the operations needed to implement the various functions and operations of the audio receiver 103. The processor 201 may be an applications processor typically found in a smart phone, while the memory unit 203 may refer to microelectronic, non-volatile random access memory. An operating system may be stored in the memory unit 203 along with application programs specific to the various functions of the audio receiver 103, which are to be run or executed by the processor 201 to perform the various functions of the audio receiver 103.

The audio receiver 103 may include one or more audio inputs 205 for receiving audio signals from an external device, e.g., a remote device. For example, the audio receiver 103 may receive audio signals from a remote server of a streaming media service. The audio signals may represent one or more channels of a piece of sound program content (e.g., a musical composition or an audio track for a movie). For example, a single signal corresponding to a single channel of a piece of multichannel sound program content may be received by an input 205 of the audio receiver 103. In another example, a single signal may correspond to multiple channels of a piece of sound program content, which are multiplexed onto the single signal. The processor 201 of the audio receiver 103 may receive as inputs multiple audio channel signals simultaneously, and processes these to produce multiple acoustic transducer drive signals (to render the audio content in the input signals as sound), e.g., as a beamforming process to control relative phases and gains for each of the signals used to drive the transducers such that the transducers generate an acoustic beam pattern along the horizontal plane.

In one embodiment, the audio receiver 103 may include a digital audio input 205A that receives digital audio signals from an external device and/or a remote device. For example, the audio input 205A may be a TOSLINK connector or a digital wireless interface (e.g., a wireless local area network (WLAN) adapter or a Bluetooth adapter). In one embodiment, the audio receiver 103 may include an analog audio input 205B that receives analog audio signals from an external device. For example, the audio input 205B may be a binding post, a Fahnestock clip, or a phono plug that is designed to receive a wire or conduit and a corresponding analog signal. In another embodiment, the processor 201 may obtain its input audio channel signals by decoding an encoded audio file, e.g., an MPEG file.

In one embodiment, the audio receiver 103 may include an interface 207 for communicating with the loudspeaker array 105. The interface 207 may utilize wired mediums (e.g., conduit or wire) to communicate with the loudspeaker array 105, as shown in FIG. 1. In another embodiment, the interface 207 may communicate with the loudspeaker array 105 through a wireless connection. For example, the network interface 207 may utilize one or more wireless protocols and standards for communicating with the loudspeaker array 105, including the IEEE 802.11 suite of standards, IEEE 802.3, cellular Global System for Mobile Communications (GSM) standards, cellular Code Division Multiple Access (CDMA) standards, Long Term Evolution (LTE) standards, and/or Bluetooth standards.

Figure 3A:
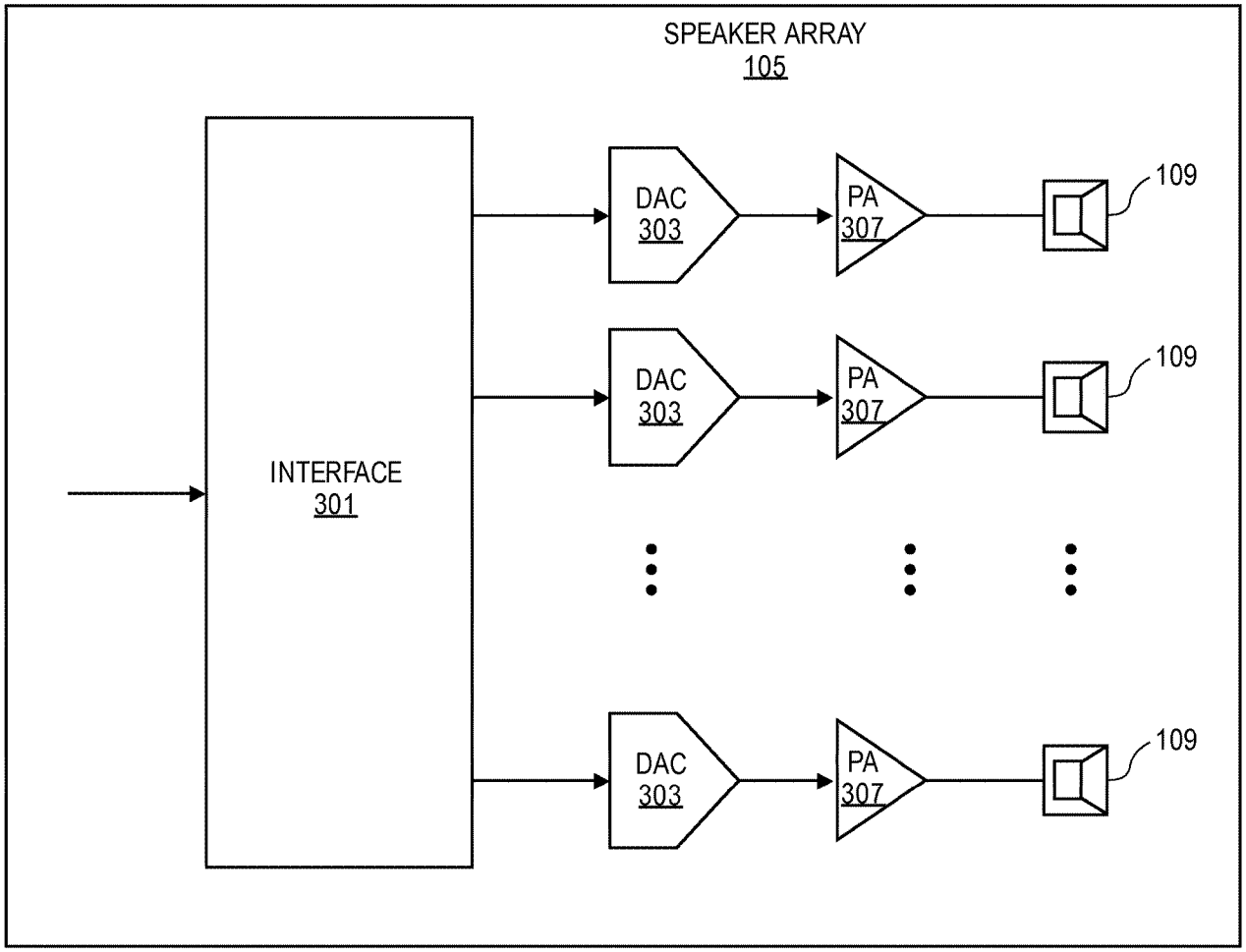
FIG. 3A shows a component diagram of the loudspeaker array according to one embodiment.

FIG. 3A shows a component diagram for the loudspeaker array 105 according to one embodiment. As shown in FIG. 3A, the loudspeaker array 105 may include an interface 301 for receiving drive signals from the audio receiver 103. The drive signals may be used for driving each of the transducers 109 in the loudspeaker array 105. As with the interface 207, the interface 301 may utilize wired protocols and standards and/or one or more wireless protocols and standards, including the IEEE 802.11 suite of standards, IEEE 802.3, cellular Global System for Mobile Communications (GSM) standards, cellular Code Division Multiple Access (CDMA) standards, Long Term Evolution (LTE) standards, and/or Bluetooth standards. In some embodiment, the loudspeaker array 105 may include power amplifiers 307 for amplifying the drive signals sent to each of the transducers 109 in the loudspeaker array 105, as well as digital to analog converters (DACs) 303 for converting the drive signals from digital domain into analog domain, both of which may be integrated into the speaker cabinet 111. Although described and shown as being separate from the audio receiver 103, in some embodiments, one or more components of the audio receiver 103 may be integrated within a housing of the loudspeaker array 105. For example, the loudspeaker array 105 may include the hardware processor 201, the memory unit 203, and the one or more audio inputs 205.

Figure 3B:
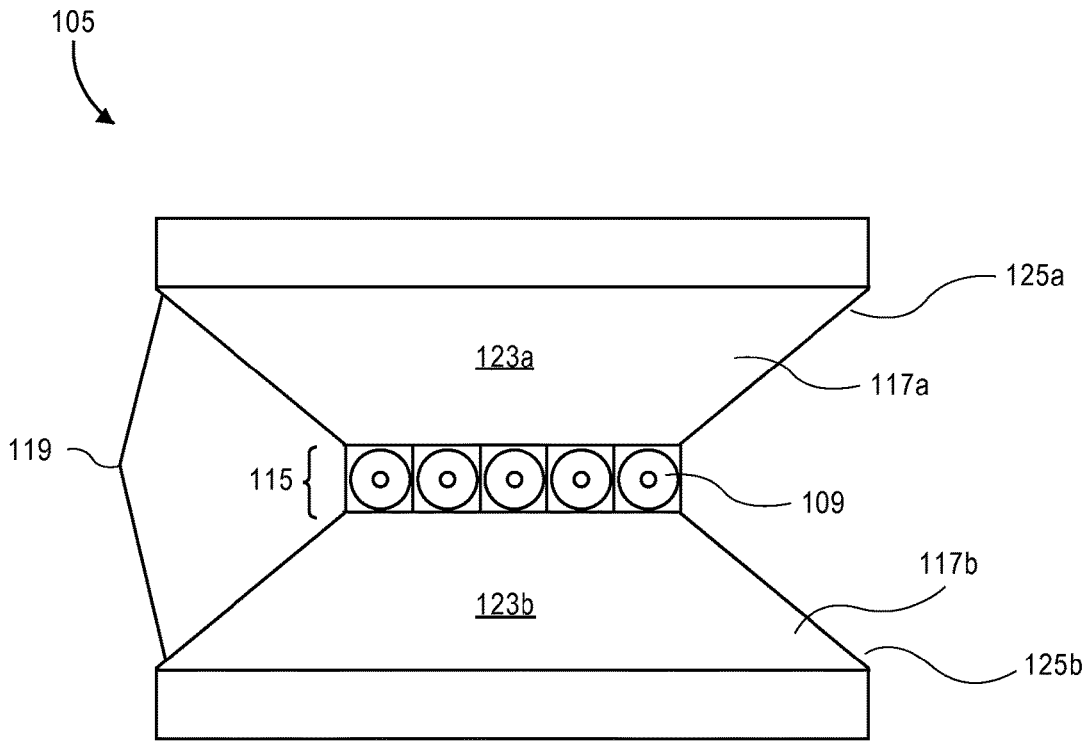
FIG. 3B shows a view of a loudspeaker array with a continuously open circumferential horn according to one embodiment.

FIG. 3B shows a side view of a loudspeaker array 105 according to one embodiment. As shown in FIG. 3B, the loudspeaker array 105 houses multiple transducers 109 in a cabinet 111. The cabinet 111 may be a loudspeaker cabinet or loudspeaker enclosure composed of two frusto conical sections 117A and 117B rotated in relation to each other by 180°, and joined to each other at their respective smaller base regions, to form a waist region in which the transducers 109 are positioned. An interior volume of the cabinet 111 may be used to house associated electronic hardware such as amplifiers and crossover circuits that are mounted inside the cabinet 111, but its primary role may be to prevent sound waves generated by rearward facing surfaces of diaphragms of the transducers 109 (not visible in FIG. 3B), interacting with sound waves generated off the front facing surfaces of the diaphragms of the transducers 109 (which are visible as illustrated in FIG. 3B) and emanating sideways and outward from the frusto conical sections 117A, 117B. As will be described in greater detail below, these frusto conical sections 117A and 117B (as joined) form a continuously open circumferential horn 113 at the waist region, which may be used for improving performance of integrated transducers 109 or for providing vertical sound control for the loudspeaker array 105. One or both of the larger base regions of the frusto conical sections 117A, 117B may be joined to a respective outer wall, depicted as outer walls 127A, 127B in FIG. 9 below.

Although described in relation to frusto conical sections 117A and 117B, in other embodiments, the cabinet 111 may be composed of any shapes or sections that provide a narrow inner circumference (or waist), to define a throat 115 of the continuously open circumferential horn 113, and a flared or wider outer section that defines a mouth 119 of the horn 113. For example, in other embodiments the cabinet 111 may be composed of one or more frustums, cones, pyramids, triangular prisms, spheres, or any other similar shape.

In some embodiments, the cabinet 111 may be defined by a hyperboloid shape that is similar to the cabinet 111 formed by the frusto conical sections 117A and 117B described above. In this embodiment, the cabinet 111 may include upper and lower sections that are wider than a middle or waist section. The upper and lower sections may taper inwards to meet the narrower middle section to form the throat 115 of the continuously open circumferential horn 113. In each of these embodiments, a horizontal cross-section of the cabinet 111, which lies in a horizontal plane that is perpendicular to the page showing FIG. 3B and that is positioned to cut through the middle section, may be circular such that the continuously open circumferential horn 113 uniformly extends around the entire perimeter of the cabinet 111.

In some embodiments, the cabinet 111 may be at least partially hollow and may allow for the mounting of transducers 109 on an inside surface of the cabinet 111 with sound output holes formed in a cylindrical wall of the waist section, each of the output holes being aligned with the diaphragm of a respective one of the transducers, or on an outside surface of the cabinet 111 (e.g., where each transducer is mounted such that its diaphragm is positioned outside or spaced outward of the cylindrical surface of the waist section). The cabinet 111 may be made of any material, including metals, metal alloys, plastic polymers, or some combination thereof.

As shown in FIG. 3A and FIG. 3B and described above, the loudspeaker array 105 may include a set of transducers 109. The transducers 109 may be any combination of full-range drivers, mid-range drivers, subwoofers, woofers, and tweeters, although in one embodiment they may all be replicates of each other. Each of the transducers 109 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 109 magnetic system interact, generating a mechanical force that causes the coil (and thus, the attached cone) to move back and forth, thereby reproducing sound under the control of the applied electrical audio signal coming from an audio source, such as the audio receiver 103. Although electromagnetic dynamic loudspeaker drivers are described for use as the transducers 109, those skilled in the art will recognize that other types of loudspeaker drivers, such as piezoelectric, planar electromagnetic and electrostatic drivers are possible. As shown in FIG. 3B and FIG. 4B, in one embodiment, the rear face of the diaphragm of each transducer 109 faces inward (into the ring formed by the entire group of transducers 9) while the front face is facing outward.

Referring back to FIG. 3A, each transducer 109 may be individually and separately driven using the power amplifiers 307 to produce sound in response to separate and discrete audio drive signals received from an audio source (e.g., the audio receiver 103—see FIG. 1). By allowing the transducers 109 in the loudspeaker array 105 to be individually and separately driven according to different parameters and settings (including delays and voltage levels), the loudspeaker array 105 may produce numerous directivity or beam radiation patterns that accurately represent each channel of a piece of sound program content received from the audio receiver 103. In some embodiments, digital filtering techniques may be used that impart variable gains and phases (relative to each other) upon the individual drive signals for the transducers 109, in the digital domain, e.g., by the processor 201 which may be part of the audio receiver 103 (see FIG. 2). A beamforming process may be performed upon a give set of two or more input audio channels, e.g., by the processor 201, to produce a number of desired acoustic output patterns, which are rendered by transferring the individual transducer drive signals (in digital form) to the DACs 303 via the interface 301.

Figure 4A:
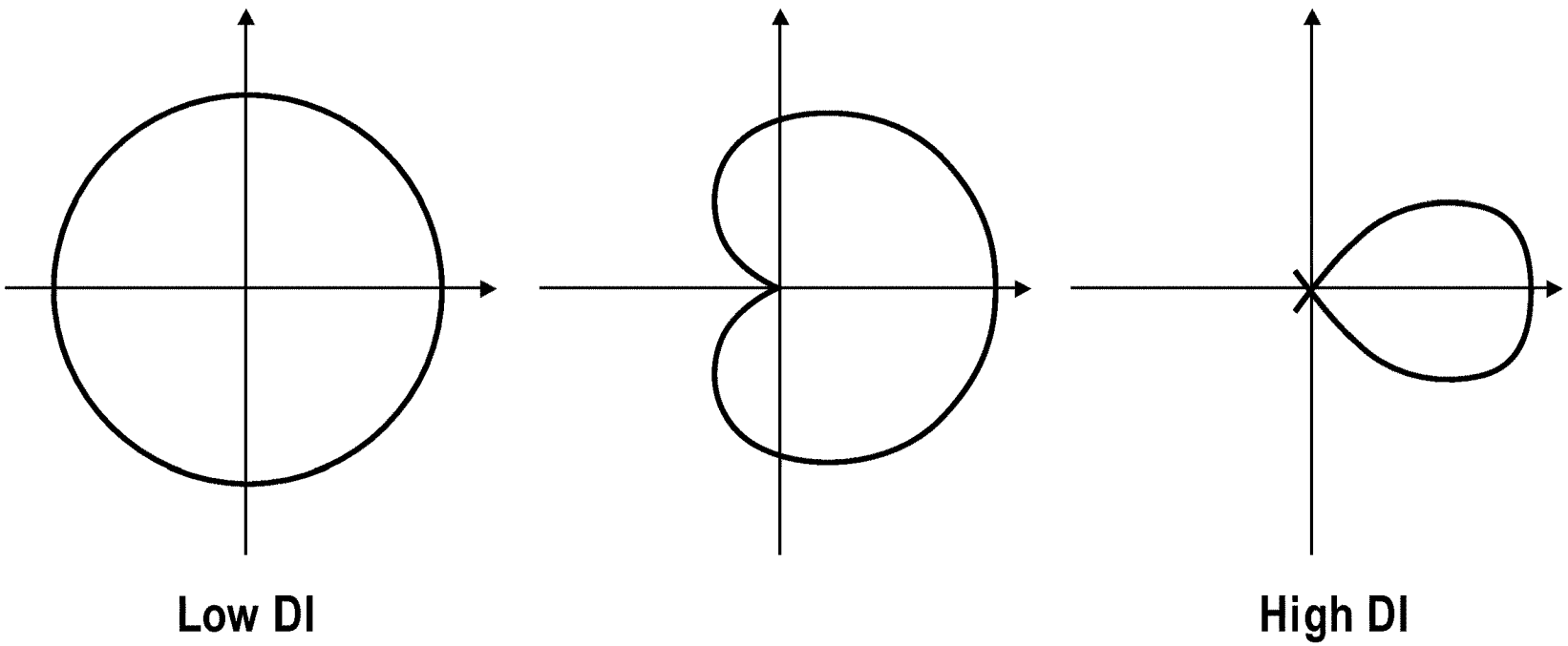
FIG. 4A shows a set of example directivity/radiation patterns that may be produced by the loudspeaker array according to one embodiment.
Figure 4B:
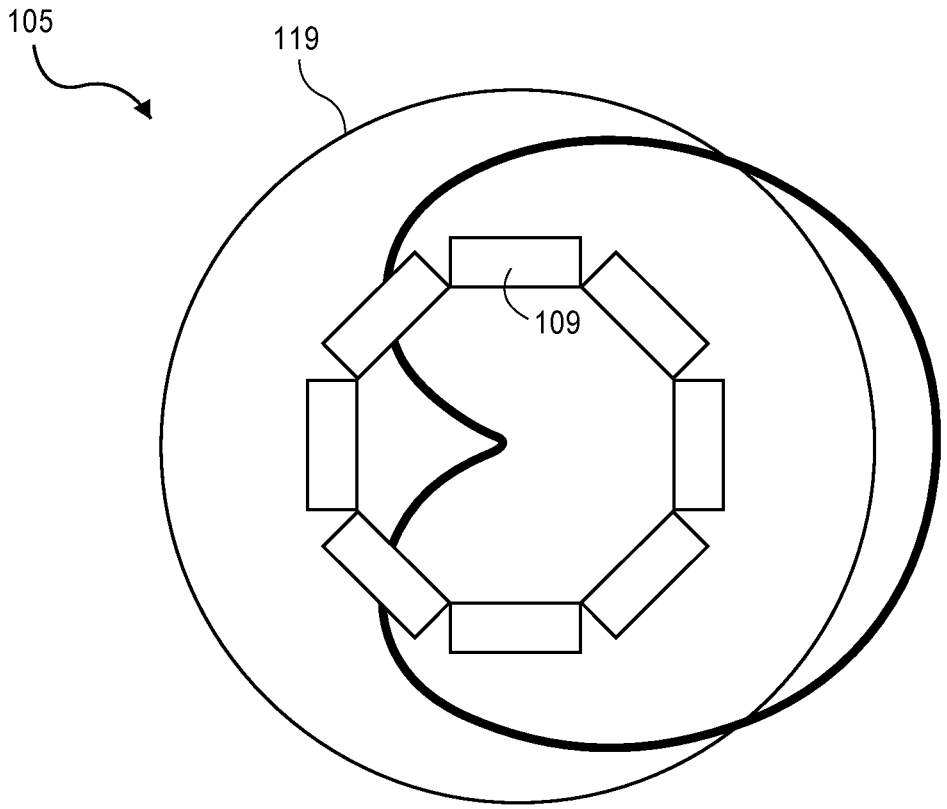
FIG. 4B shows a top view of a loudspeaker array emitting a forward facing cardioid radiation pattern in a horizontal plane using a set of transducers according to one embodiment.

For example, in one embodiment, the loudspeaker array 105 may produce one or more of the directivity or radiation patterns shown in FIG. 4A along a horizontal plane that is perpendicular to the upright stance of the cabinet 111 as seen in the earlier figures (or that is perpendicular to the central upright axis 102). In FIG. 4A, an omnidirectional pattern is shown on the right (having a low directivity index, DI), a hypercardiod pattern is shown on the right (having a high DI), while a cardiod pattern is shown in the middle. FIG. 4B shows a top view of a loudspeaker array 105 emitting a forward (or right) facing cardioid radiation pattern in a horizontal plane using a set of transducers 109 according to one embodiment. Simultaneous directivity patterns produced by the loudspeaker array 105 may not only differ in shape, but may also differ in the direction of their respective reference axes. For instance, different directivity patterns may be "pointed" in different directions in the listening area 101 to represent separate channels or separate pieces of sound program content for separate zones or separate listeners 107.

Power or gain performance from the transducers 109 may be lacking, if the transducers 109 have to be made smaller in order to fit into a smaller cabinet 111. To improve the performance of the transducers 109, a horn may be used at the primary sound output opening of each transducer 109 (or selected ones of the transducers 109). In particular, an acoustic horn may be used to 1) increase the efficiency of a transducer 109 (e.g., add acoustic gain for sound output by a transducer 109) and/or 2) to control the direction in which the sound is radiated into the listening area 101.

Figure 5A:
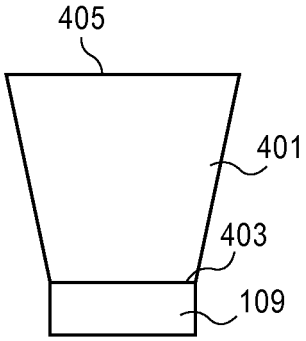
FIG. 5A shows a horn coupled to a transducer according to one embodiment.

For example, as shown in FIG. 5A, a single transducer 109 is connected to the throat 403 of a horn 401, and the cross sectional area of the horn 401 increases with distance from the throat 403 to the mouth 405 of the horn 401. The change in cross section with distance and the detailed shape of the horn 401 may be chosen to add a specified level of gain to sound emitted by the transducer 109 for a specified frequency range of operation. In this sense, the horn 401 may be considered an acoustic transformer that provides impedance matching between the diaphragm material of the transducer 109 and the less-dense air surrounding the loudspeaker array 105. The result is greater acoustic output power from transducer 109. The shape of the horn 401 may also be designed to give different passive directivity properties.

Historically, horns were very useful in increasing acoustic gain when amplifiers were not yet available. Although amplifiers are now readily available, horns may continue to be useful as they still improve the gain performance of transducers 109 in particular frequency ranges and may provide passive directional control. Accordingly, horns may allow the use of smaller transducers 109 in mobile or other compact devices where amplifiers may not be suitable options (e.g., size or thermal considerations).

Figure 5B:
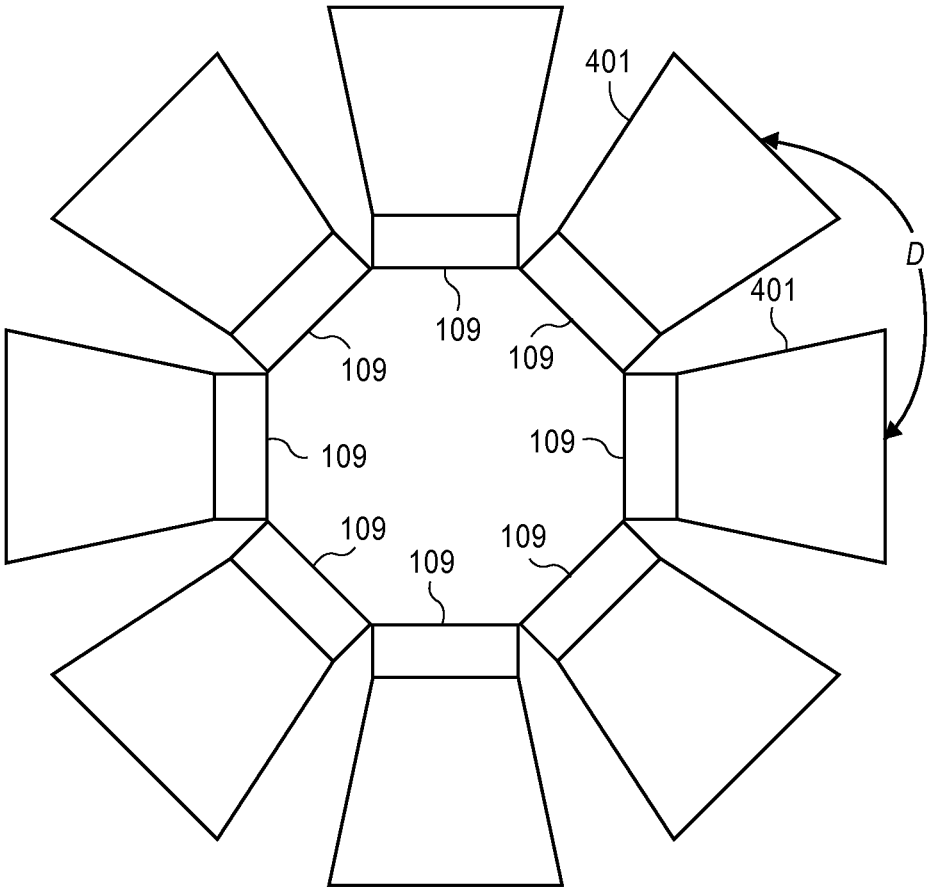
FIG. 5B shows a set of horns coupled to a set of transducers according to one embodiment.

In some embodiments, the horn 401 shown in FIG. 5A may be used with multiple transducers 109 arranged alongside each other. For example, as shown in FIG. 5B, multiple horns 401 may be used with multiple transducers 109, respectively, that are positioned side by side in a ring or circular formation. In this embodiment, sound from each transducer 109 travels through a corresponding throat 403 of its horn 401, and mixes with sound from adjacent transducers 109 upon exiting at the mouth 405 of its horn 401. Accordingly, the horn 401 in this arrangement provides a sound barrier between adjacent transducers 109, where this barrier extends from the throat 403, which is proximate and coupled to the transducer 109, to the mouth 405 such that sound from adjacent transducers 109 is not permitted to mix until after escaping the horn 401.

The distance D shown in FIG. 5B represents the separation between points where sounds from adjacent transducers 109 are allowed to mix together (i.e., the point in this case where sounds leave respective horns 401). The horns 401 shown in FIG. 5B draw sound outward and away from the transducers 109 (using a set of barriers or walls that define the shape of the horns 401) before a sound can be mixed with sound from other transducers 109, and this may dictate the distance D. In particular, since the horn 401 flares outward, as the design of the horn 401 increases in length (e.g., calculated from the throat 403 to the mouth 405), the horns 401 and their corresponding transducers 109 may need to be more greatly separated from each other. This increased distance or spacing between the transducers 109 results in a similar increase to the mixing distance D between adjacent horns 401. For simplicity and consistency, this distance D may be measured (for each adjacent pair of horns 401) along any suitable, mathematically defined curve that connects the centers of the mouths 405 of adjacent horns 401. Similarly, for the embodiment of FIG. 6, the mixing distance D may be measured along a suitable, mathematically defined curve (in front of the transducers 109) that connects the centers of the diaphragms of adjacent transducers 109.

In some cases, mixing of sounds produced by transducers 109 may cause aliasing issues. Aliasing may be restricted to particular frequency bands based on the distance D. For example, aliasing may occur when a wavelength of sound produce by the transducers 109 is smaller than the mixing distance D. In other words, the sound produced by adjacent transducers 109 (and as heard by the listener 107) may exhibit aliasing at wavelengths that are smaller than a threshold wavelength (or equivalently at frequencies that are higher than a threshold frequency.) Since higher frequency sounds have shorter wavelengths in comparison to lower frequency sounds, as the distance D increases the frequencies of sound that may be produced by the transducers 109 without aliasing effects decreases (e.g., an inverse relationship between the mixing distance D and the aliasing frequency). In other words, the "aliasing frequency" (the frequency above which there is substantial aliasing in the sound that may be heard at a position of the listener 107) drops, as the mixing distance D increases. Accordingly, to ensure that sounds may be produced at higher frequencies by the loudspeaker array 105 without the occurrence of aliasing effects, the mixing distance D should be decreased.

In one embodiment, the loudspeaker array 105 described herein reduces the distance D by providing a continuously open circumferential horn 113. As described above and shown in FIG. 3B, the continuously open circumferential horn 113 may include a throat 115, a mouth 119, and a set of inner walls 123*a*, 123*b*. The throat 115 is defined by the narrowest end of the horn 113 and is proximate or coupled to the ring of transducers 109. In contrast, the mouth 119 is formed at the opposite end of the horn 113 and is defined by the widest end of the horn 113. The inner walls 123*a*, 123*b* mark the upper and lower halves, or upper and lower bounds, respectively, of the horn 113 and may provide a tapered or angled connection between the throat 115 and the mouth 119 such that the horn 113 flares outwards (i.e., increases in diameter moving from the throat 115 to the mouth 119).

Figure 6:
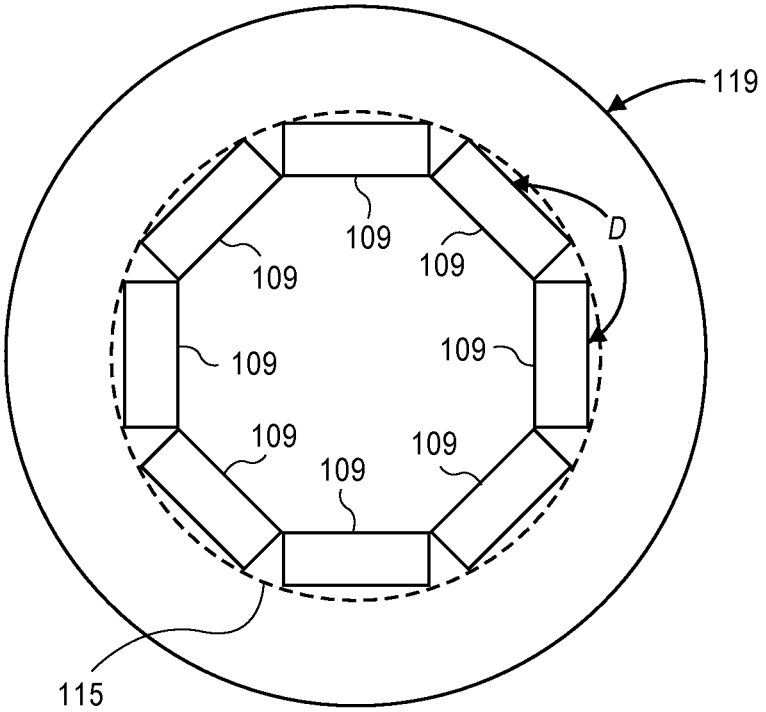
FIG. 6 shows the mixing distance for a set of transducers when using the continuously open circumferential horn according to one embodiment.

The combined throat 115, mouth 119, and inner walls 123 may extend the entire circumference or perimeter of the cabinet 111 (e.g., 360° around a center upright axis 102 of the cabinet 111) such that the horn 113 is circumferentially open and no barriers are present between transducers 109. In comparison to the arrangement in FIG. 5B in which each individual horn 401 creates a sound barrier for each corresponding transducer 109, the continuously open circumferential horn 113 depicted in FIG. 3B may allow the placement of multiple transducers 109 side by side at the throat 115, without barriers between each transducer 109. Although the inner walls 123 form upper and lower barriers for sound produced by the transducers 109, these inner walls 123 do not restrict mixing of sound between transducers 109. For example, FIG. 6 shows a top view of an arrangement of as in FIG. 3B, in which the transducers 109 are side by side around the throat 115 of the continuously open circumferential horn 113. Since in this embodiment no barriers are present between each adjacent pair of the transducers 109, sound from each of the transducers 109 may be mixed together soon after being produced or emitted by the transducers 109 (e.g., they are mixed in the throat 115 of the horn 113). In particular, the mixing distance D at which sound from adjacent transducers 109 is mixed may be reduced in comparison to the distance D shown in FIG. 5B.

Based on this reduced mixing distance D between sounds from adjacent transducers 109 entering into the same environment (e.g., see FIG. 1, the throat 115 of the horn 113) and being allowed to mix together, the aliasing frequency may be increased when using the continuously open circumferential horn 113. As noted above, the aliasing frequency is the frequency at which higher frequency sounds may cause undesirable aliasing effects, based on the mixing distance D. Accordingly, since the continuously open circumferential horn 113 provides a higher aliasing frequency based on the reduced mixing distance D in comparison to the closed or segmented horns 401 shown in FIG. 5B, the transducers 109 in FIG. 3B and FIG. 6 may be driven with higher frequency sounds without the presence of aliasing effects. Further, the continuously open circumferential horn 113 may still provide efficiency improvements (i.e., improved gain performance) and vertical sound control similar to traditional horn designs.

Figure 9:
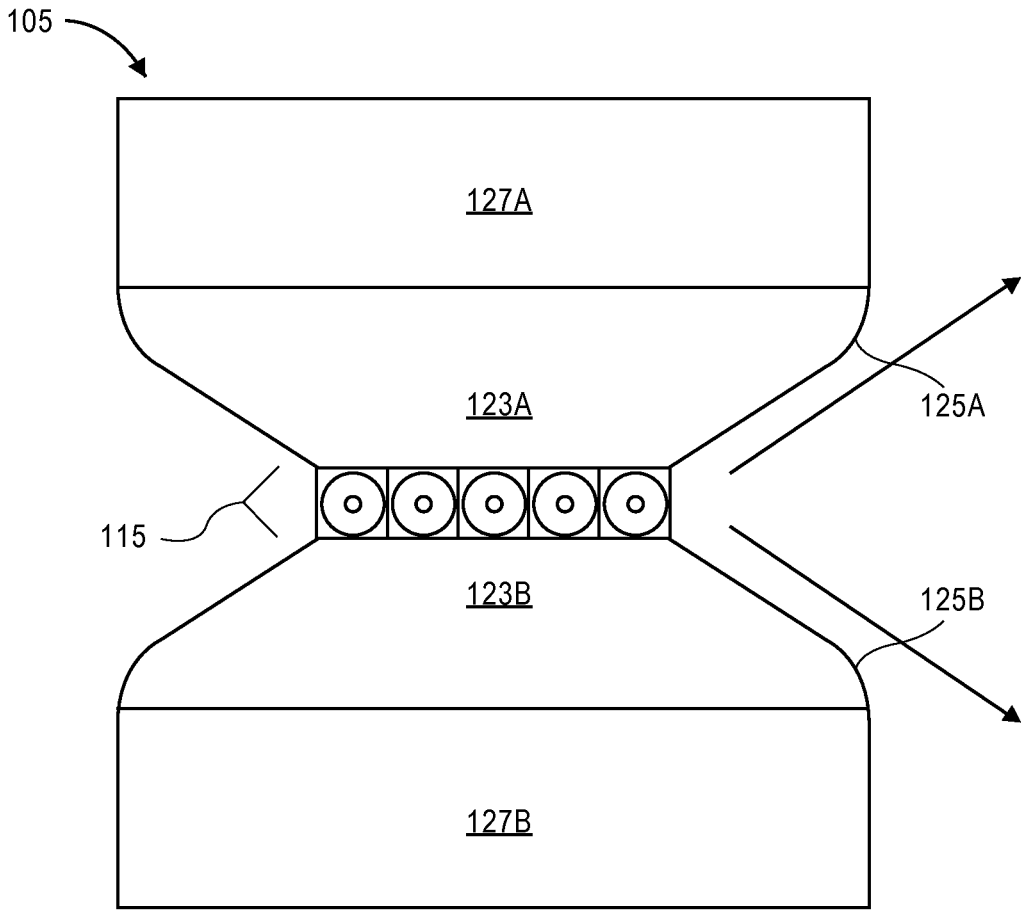
FIG. 9 shows a view of a loudspeaker array with a continuously open circumferential horn according to one embodiment.

In one embodiment, the continuously open circumferential horn 113 may be formed using components of the cabinet 111. For example, as described above, the cabinet 111 may be formed of the two frusto conical sections 117A and 117B, which are joined together as shown in FIG. 3B. In particular, one of the two frusto conical sections 117A and 117B may be rotated 180° in relation to the other and then joined to form a generally hourglass or hyperboloid shape for the cabinet 111. The bottom of the lower section 117B may be flat so as to enable the cabinet 111 to stably rest on a flat surface such as a tabletop as shown in the example of FIG. 1, or on a floor. This generally hourglass or hyperboloid shape has a narrow or tapered section that defines the throat 115 of the horn 113 and a wide or flared section that defines the mouth 119 of the horn 113. Although described as being formed of separate sections 117A and 117B that are joined or otherwise coupled together, the cabinet 111 may be made in different ways such as two or more vertically or horizontally continuous pieces that are joined together. The continuously open circumferential horn 113 may have a curved surface at the corners 125A, 125B of its mouth 119 so that the cabinet 111 has a true hyperboloid shape, as depicted in FIG. 9, for example.

In one embodiment, the ring of transducers 109 may be located around the throat 115 of the continuously open circumferential horn 113. As shown in FIG. 3B and FIG. 6, the transducers 109 may be aligned in a horizontal plane, around the throat 115, such that each of the transducers 109 is vertically equidistant from the larger base of the upper section 117A and is vertically equidistant from the larger base of the lower section 117B of the cabinet 111.

Figure 7:
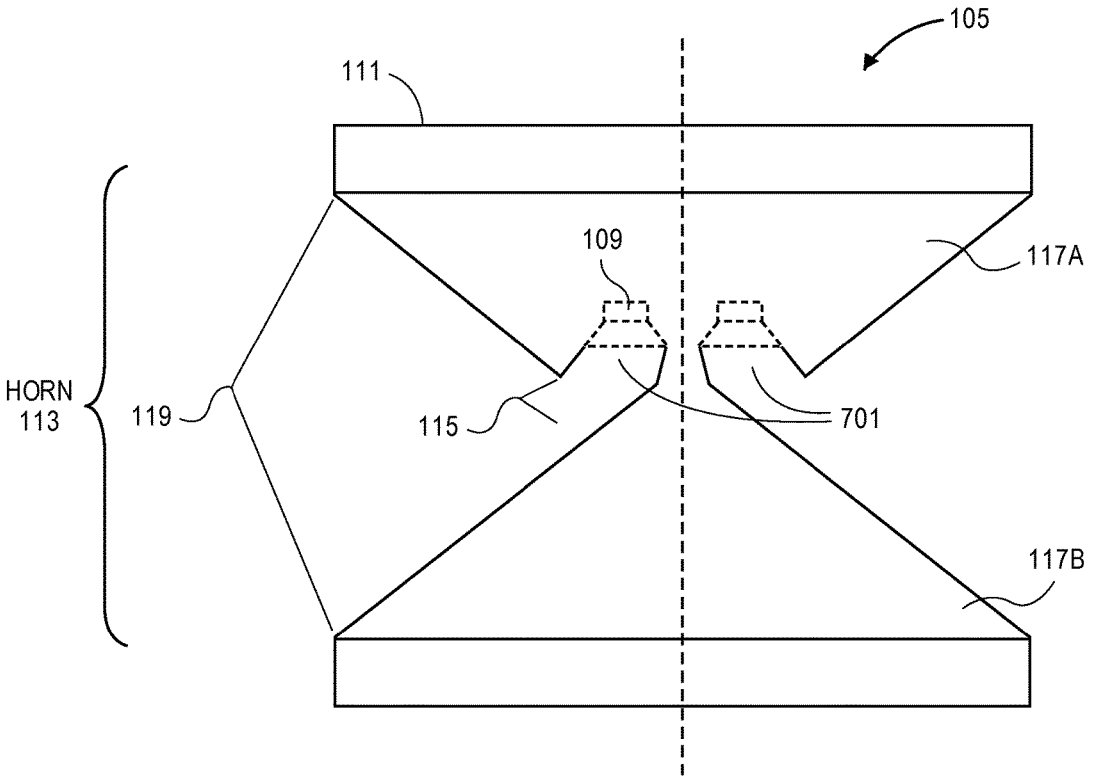
FIG. 7 shows a set of transducers stored within an upper section of the loudspeaker array and directing sound through the continuously open circumferential horn according to one embodiment.

Although as shown in FIG. 3B and FIG. 6 and described above the transducers 109 are arranged uniformly at the throat 115 of the horn 113 with their diaphragms oriented substantially vertically, in other embodiments the transducers 109 may be differently arranged around or about the throat 115 of the horn 113. For example, since the throat 115 of the continuously open circumferential horn 113 is formed at a narrowest or waist section of the cabinet 111, arranging all of the transducers 109 along this section, with their diaphragms in a vertical orientation, may be difficult. Namely, the constricted space provided by the throat 115 may not allow the use of large, more powerful transducers 109 (unless the diameter of the throat is made larger, and the top and bottom sections 117*a*, 117*b* of the cabinet are also made larger.) The limited space may also result in heat issues caused by poor thermal dissipation in a confined area with a high density of transducers 109. To alleviate these space constraints, some or all of the transducers 109 (that together may form a ring) may instead be located within a hollow portion of the upper section 117A, which is above the throat 115 (and below a top of the upper section 117*a*) as shown in FIG. 7. Since the horn 113 tapers such that the throat 115 is the narrowest element of the cabinet 111 (from a side view, as in FIG. 7), any portion of the progressive widening upper section 117A above the throat 115 may afford more space for the placement or mounting of the transducers 109, and in particular their motors which are directly behind, and attached to drive, their respective diaphragms, in comparison to mounting of the transducers 109 at the throat 115, e.g., all oriented vertically as shown in FIG. 3*b* and FIG. 4*b*. In the embodiment of FIG. 7, sound produced by the transducers 109 may be directed to flow into the continuously open circumferential horn 113 through the slots 701. The slot 701 may be a passageway that extends into the cabinet 111, from the outer surface of a side wall of the upper section 117A, and that acoustically joins the front surface of the diaphragm of each respective transducer 109 to the throat 115 (of the continuously open circumferential horn 113.) In some embodiments, one or more of the slots 701 may include one or more bends or curves. The bends or curves allow the transducers 109 to be placed or mounted in different positions and orientations within the cabinet 111 while still allowing for sound produced by each transducer 109 to reach the throat 115 of the continuously open circumferential horn 113. In the version shown in FIG. 7, the slots 701 are such that they enable their respective transducers 109 to be oriented so that their diaphragms are substantially horizontal (instead of vertical as in FIGS. 3*b*, 4*b*), thereby allowing more space for their respective motors within the upper section 117*a*. Since the slots 701 deliver sound produced by corresponding transducers 109 at the same point around the throat 115 as when the transducers 109 are mounted at the throat 115 as shown in FIG. 3B, the mixing distance D between adjacent transducers 109 may remain the same or nearly identical. Given that the mixing distance D remains small (in comparison to the horns 401 shown in FIG. 5A and FIG. 5B), the aliasing frequency for the loudspeaker array 105 shown in FIG. 7 may remain high as described above, such that high frequency sounds may be emitted by the transducers 109 without the presence or occurrence of aliasing effects.

Figure 8:
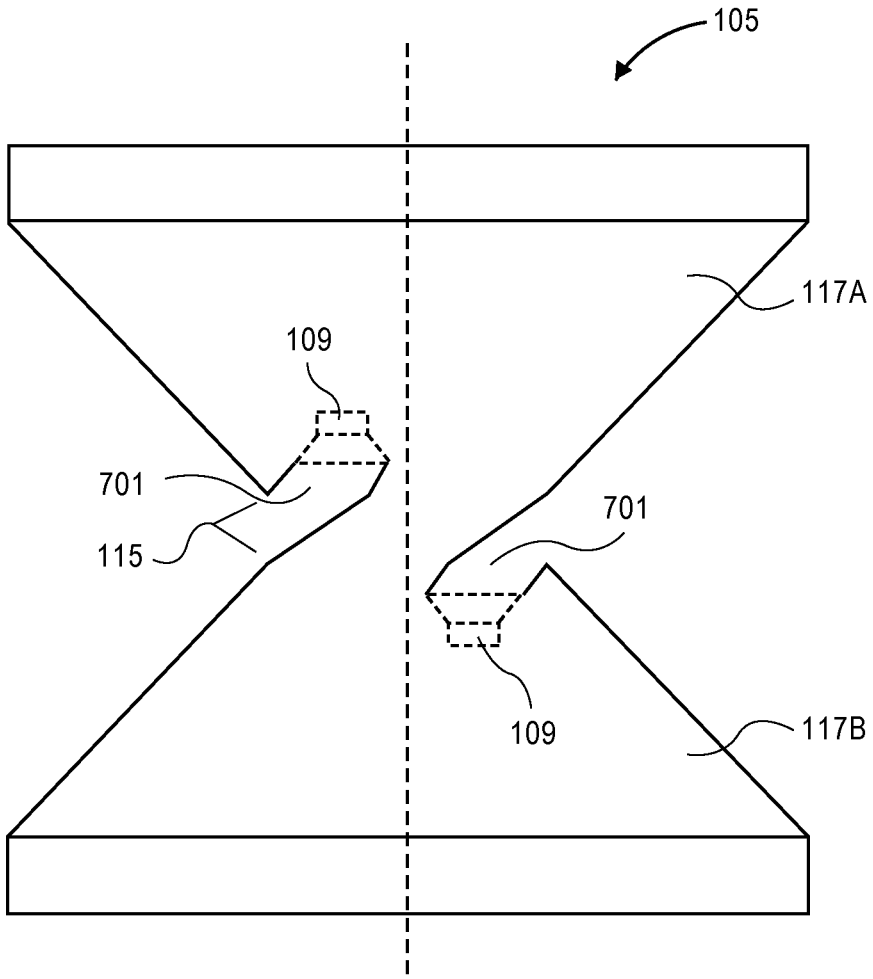
FIG. 8 shows a set of transducers stored within an upper section and a lower section of the loudspeaker array and directing sound through the continuously open circumferential horn according to one embodiment.

Although as described above and shown in FIG. 7 all of the transducers 109 are housed entirely within the upper section 117A, in another embodiment all of the transducers 109 (together still forming a ring) may be similarly placed or mounted entirely within the lower section 117B. In some other embodiments, the transducers 109 may be alternately placed within (alternating between) the top and lower sections 117A and 117B as shown in FIG. 8. In this embodiment, within each top or bottom section 117*a*, 117*b*, there is even more space between adjacent ones of the transducers 109 that are within the same section 117*a*, 117*b* of the cabinet 111 for mounting, since the transducers 109 are alternately placed above and below the throat 115. Similar to the loudspeaker array 105 shown in FIG. 7, the loudspeaker array 105 shown in FIG. 8 may utilize slots 701 to direct sound from the transducers 109 to the throat 115 of the continuously open circumferential horn 113.

As described above, the continuously open circumferential horn 113 reduces aliasing effects between adjacent transducers 109 in the loudspeaker array 105. In particular, the mixing distance D between adjacent transducers 109 (e.g., transducers 109 that are directly adjacent in the ring of transducers 109) may be decreased such that a corresponding aliasing frequency is increased. This aliasing frequency describes the highest frequency that may be emitted by the transducers 109 without generation or production of aliasing effects caused by mixing of sound between transducers 109. Accordingly, by decreasing the mixing distance D, the continuously open circumferential horn 113 increases the range of frequencies that may be produced by the transducers 109 without unwanted effects.

As shown in FIG. 3B and FIG. 4B and described above, the loudspeaker array 105 may include a single ring of transducers 109 that are positioned side by side as shown. In one embodiment, each of the transducers 109 in the ring of transducers 109 may be of the same type or model, e.g., replicates. The ring of transducers 109 may be aligned along or in a horizontal plane such that each of the transducers 109 is vertically equidistant from a planar, larger base of the top frusto conical section 117A and is vertically equidistant from a planar, larger base of the bottom frusto conical section 117B of the cabinet 111. Further, this horizontal plane may be perpendicular to the upright stance of the cabinet 111 (as it is shown in the figures). Although a single ring of transducers 109 aligned along a horizontal plane may provide dynamic horizontal beam control through adjustment of relative gains and phases of drive signals applied to each transducer 109, vertical control of sound emitted by the loudspeaker array 105 may be limited. In particular, by lacking multiple stacked rings of transducers 109, dynamic directional control of sound may be limited to this horizontal plane.

Since dynamic vertical control of sound produced by the single ring of transducers 109 may not be possible, more passive solutions may be used. For example, the continuously open circumferential horn 113 may be used to assist in controlling the vertical spread of sound from the ring of transducers 109 into the listening area 101. As shown in FIG. 9, the continuously open circumferential horn 113 may be flared to control the direction of sound along a vertical axis. The horn 113 may be adjusted during manufacture to accommodate for different performance requirements of the loudspeaker array 105. For example, the angle of the upper and lower inner walls 123*a*, 123*b* (relative to the horizontal plane) and the corresponding size of the mouth 119 may be adjusted to create a larger or smaller vertical spread of sound into the listening area 101 (see FIG. 1.) In other embodiments, the corners 125*a*, 125*b* that connect the inner walls 123*a*, 123*b* to the outer walls 127*a*, 127*b*, respectively, and which define the entrance of the mouth 119, may be curved or rounded as shown in FIG. 9. This curvature may provide a more consistent frequency response in comparison to a sharp or abrupt corner 125 such as depicted in FIG. 3B.

Although the design of the horn 113 in FIG. 3B may reduce aliasing effects as described above, its sharp corners 125 may apply an inconsistent improvement or increase in gain across all frequencies. Instead, the sharp corners 125 may lead to peak improvements in gain across some frequencies while providing less or no increases in gain in other frequency ranges (e.g., particularly with low frequency content). This inconsistent response across frequencies may create undesirable changes to sound produced by the loudspeaker array 105. In contrast, the curved corners 125 of the horn 113 shown in FIG. 9 may provide a more desirable horn design that is less likely to have reduced gain at low frequencies. In particular, in the horn 113 of FIG. 9 the sidewall 123*a* may gradually flare off at the corner 125*a* and join the vertically oriented outer wall 127; similarly, the sidewall 123*b* flares off at the corner 125*b* and joins the vertically oriented outer wall 127*b*. A more consistent frequency response for sound produced by the transducers 109 using these curved corners 125 may be expected.

Figure 10:
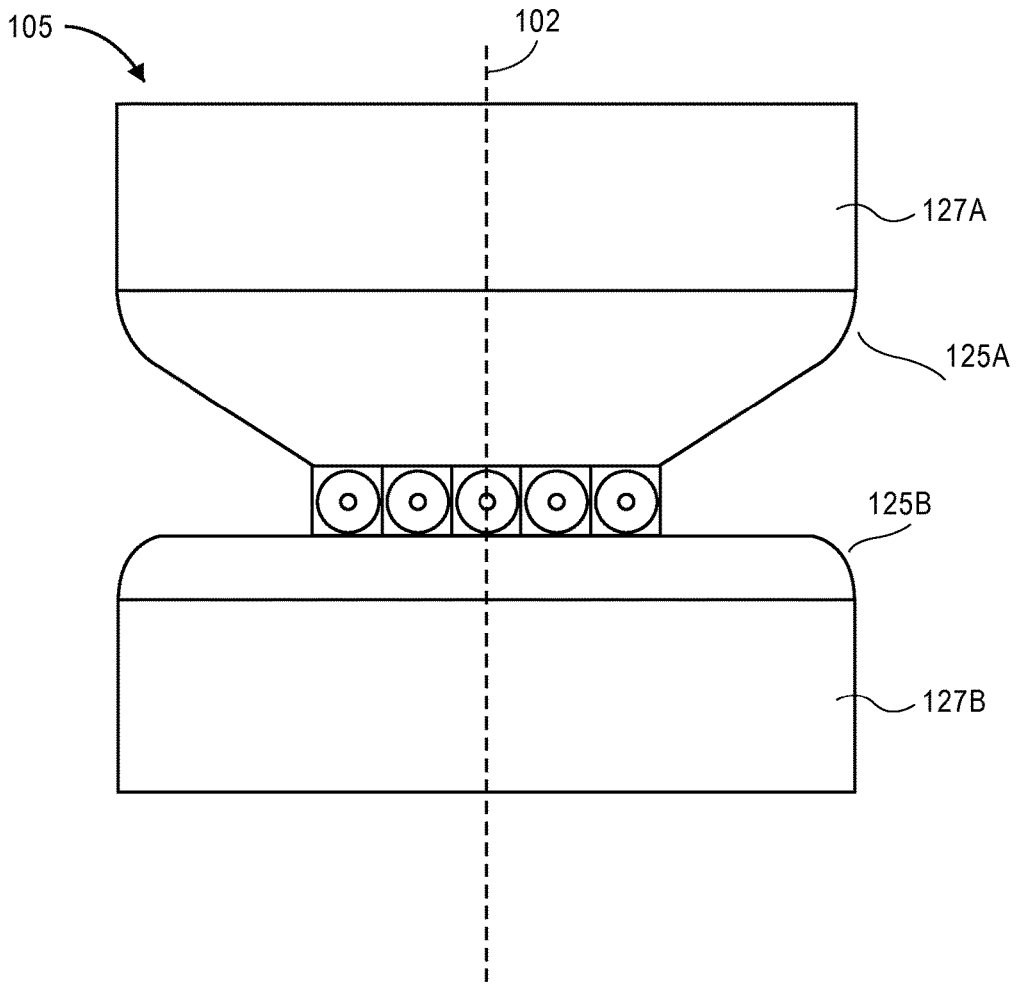
FIG. 10 shows a view of a loudspeaker array with differently angled inner walls for a continuously open circumferential horn according to one embodiment.

Although shown in FIG. 9 as being identical, the angle and shape of the inner wall 123*a* (along or defined by the upper section 117A) may, alternatively, be different in comparison to the angle and shape of the inner wall 123*b* (along or defined by the lower section 117B.) For example, as shown in FIG. 10, the inner wall 123*b* along the lower section 117B may be planar and perpendicular relative to the vertically oriented center upright axis 102, e.g., entirely horizontal, while the inner wall 123*a* along the upper section 117A remains similar as in the earlier embodiments, such as FIG. 9, that is not planar and sloped upward (in relation to the horizontal plane.) Further, the corner 125*b* of the lower section 117B may be sharper in comparison to the corner 125*a* of the upper section 117A, as shown. In this embodiment, the lack of slope to the inner wall 123*b* and the sharply angled corner 125*b* (of the lower section 117B) may assist the horn 113 in directing sound away from a possibly reflective surface upon which the loudspeaker array 105 may be situated (e.g., a table or a floor). The upward slope of the inner wall 123*a* and curved corner 125*a* of the upper section 117A may direct sound produced by the transducers 109 towards the listener 107. In other embodiments, the upper and lower sections 117A and 117B of the horn 113 (cabinet 111) may be formed in different fashions to provide desired vertical control of sound output.

Figure 11:
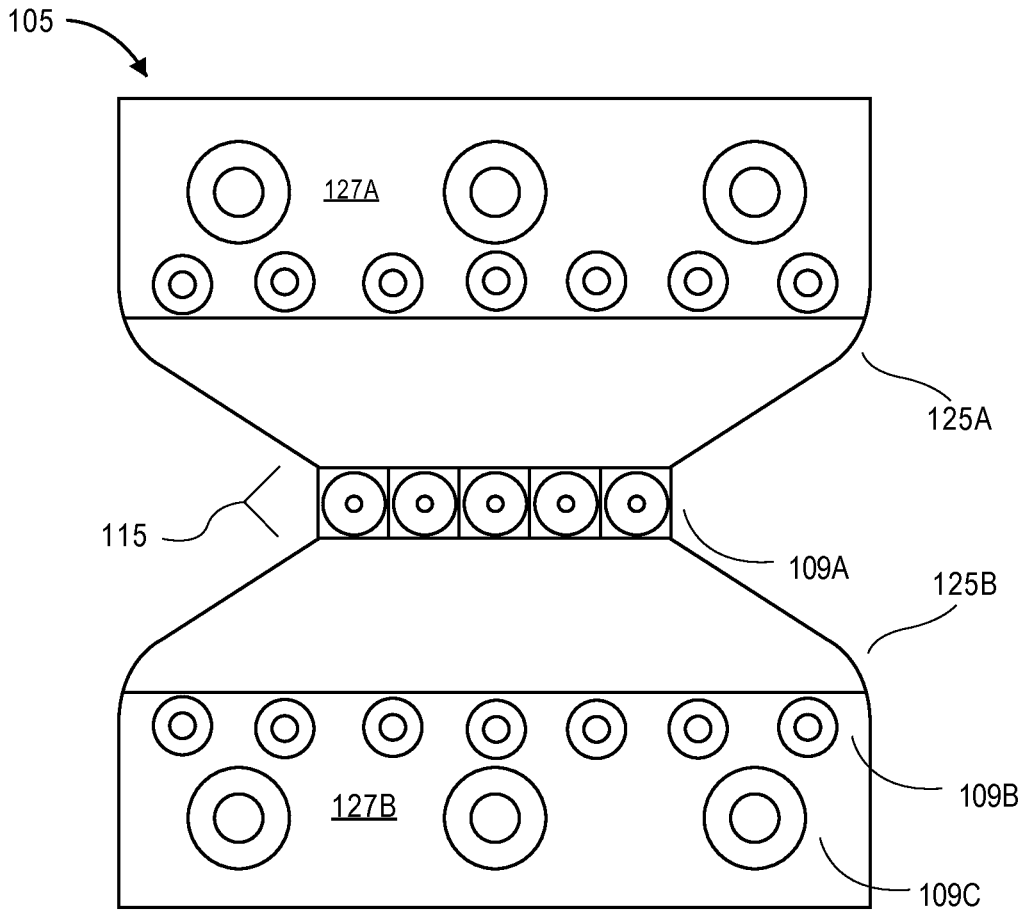
FIG. 11 shows a loudspeaker array with different types of transducers according to one embodiment.

Although described above in relation to a single ring of identical transducers 109, the loudspeaker array 105 may include additional transducers arranged along and within the cabinet 111. For example, FIG. 11 shows a loudspeaker array 105 with a first set of transducers 109A used for producing, or designed to be driven by, a first set of audio frequencies (where the first set of transducers 109A may be a single ring of transducers such as the transducers 109 depicted in FIG. 3B, a second set of transducers 109B used for producing, or designed to be driven by a second set of frequencies, and a third set of transducers 109C used for producing, or designed to be driven by a third set of frequencies. In this example, there is a group of transducers 109B, 109C that are housed within the section of the cabinet 111 that is below the horn 113 and defined by the outer wall 127B, and another group of transducers 109B, 109C that are housed within the section of the cabinet 111 that is above the horn 113 and defined by the outer wall 127A. For instance, the first set of transducers 109A may be used or designed for high frequency content (e.g., 5 kHz-10 kHz), the second set of transducers 109B may be used or designed for mid frequency content (e.g., 1 kHz-5 kHz), and the third set of transducers 109C may be used or designed for low frequency content (e.g., 100 Hz-1 kHz). These frequency ranges for driving each of the transducers 109A, 109B, and 109C may be enforced using a set of filters that may be integrated within the loudspeaker array 105 (not shown). Since the wavelengths for sound waves produced by the first transducers 109A are smaller than wavelengths of sound waves produced by the transducers 109B, the mixing distance D associated with these transducers 109A (see FIG. 6) should be designed to be smaller than the mixing distance D associated with the transducers 109B. In particular, to prevent aliasing effects the mixing distance D for the transducers 109A should be small enough such that the small wavelengths produced by high frequency content are not smaller than the distance D. However, since the transducers 109B produce lower frequency content (i.e., mid frequency content) with larger wavelengths, the distance D for transducers 109B may be made larger, e.g. the transducers 109B do not need to be as tightly packed as the transducers 109A. Similarly, the transducers 109C may be arranged to have a larger mixing distance D than both the transducers 109A and the transducers 109B. Since the mixing distances D for the transducers 109B and the transducers 109C may be made larger without the occurrence of aliasing effects, a continuously open circumferential horn 113 that enables a reduction in the distance D may not be necessary for these transducers 109B and 109C. In these embodiments, a traditional horn 401, such as those shown in FIG. 5A and FIG. 5B, may be added to one or more of the transducers 109B, 109C, if gain efficiency improvements or directional control for these rings of transducers 109B and 109C are desired.

Figure 12:
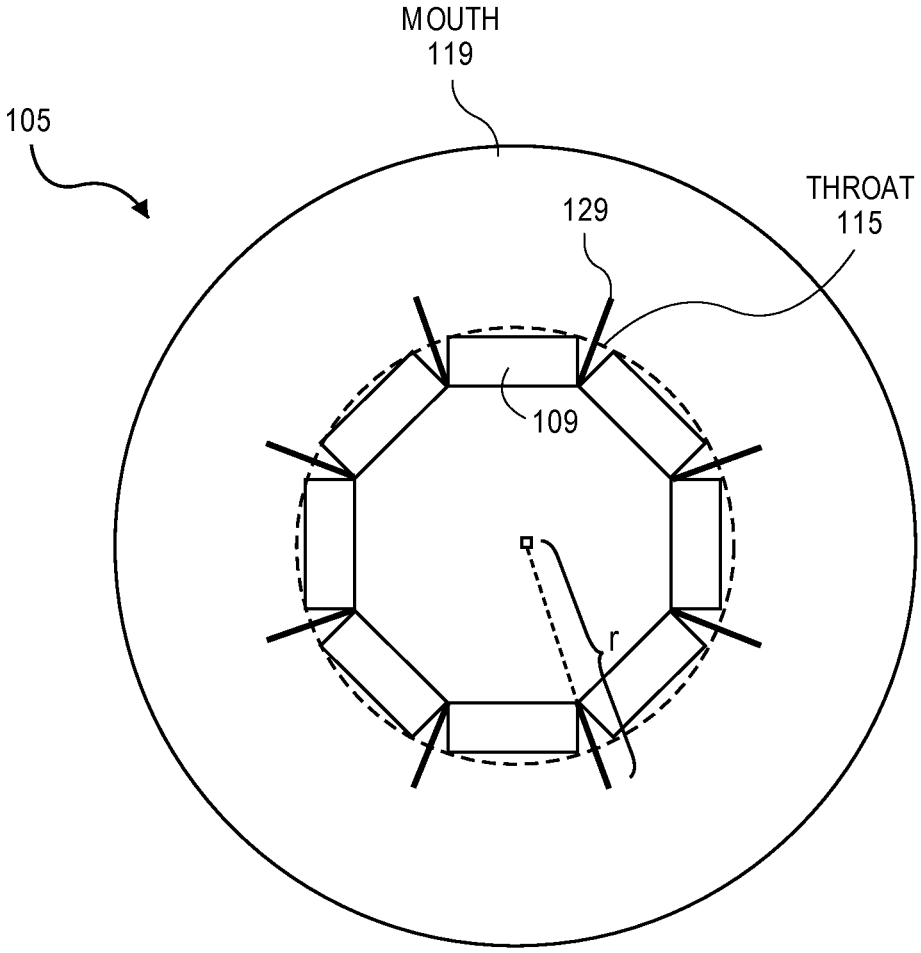
FIG. 12 shows an overhead view of a loudspeaker array with a set of dividers according to one embodiment.

Although the open circumferential horn 113 is described above as a "completely open" circumferential horn 113, in some embodiments a divider 129 may be added or placed between an adjacent pair of transducers 109 as shown in FIG. 12. A divider 129 may be a flat, rigid piece or segment that extends outward from the throat 115 between an adjacent pair of transducers 109, generally transverse to or perpendicular to the inner walls 123*a*, 123*b*, along a of the horn 113 (in the case where the horn 113 defines a circular mouth 119.) Although not shown in the drawings, the divider 129 may be joined to both of the inner walls 123*a*, 123*b* and may widen in the vertical direction (as it extends outward and along the inner walls 123*a*, 123*b*.) An adjacent pair of the dividers 129 may be viewed as partitioning=a portion of the mouth 119 of the horn 113 for each transducer 109. The length dimension of the divider 129, e.g., measured along the radius (r) taken from the center of a circular mouth 119 which may be concentric with a circular throat 115 as shown in FIG. 12, may be selected to trade off between the frequency where aliasing begins and the amount of directivity control that may be achieved at lower frequencies for a given amplifier power and transducer 109 excursion. For example, a set of the dividers 129 as shown in FIG. 12, for all of the transducers 109, may each be between 25 millimeters and 60 millimeters long between its inner end point at the throat 115 and its outer end point. In contrast to the embodiment of FIG. 12, in other embodiments the dividers 129 extend the entire distance from the mouth 119 to the throat 115 (of the otherwise continuously open circumferential horn 113.) The dividers 129 may be sized (as in FIG. 12) to extend to only a fraction of the distance from the mouth 119 to the throat 115.

Figure 13:
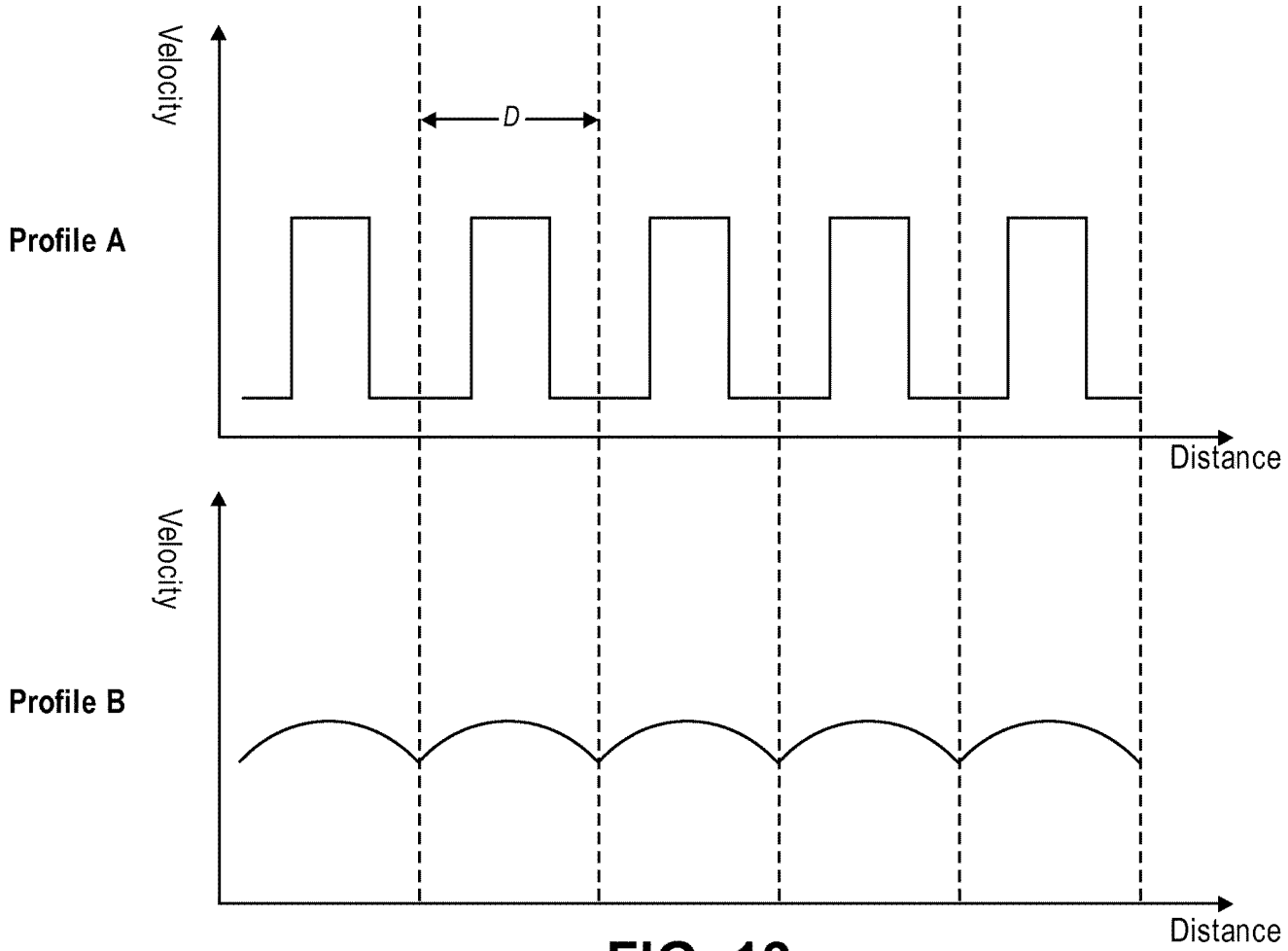
FIG. 13 shows a set of example sound velocity profiles for a set of loudspeaker arrays according to one embodiment.

Additionally, the dividers 129 may provide an effective "short horn" for the sound emerging from the transducers 109 prior to being mixed within the shared space of the circumferential horn 113 (that is within the boundary of mouth 119 depicted in FIG. 12). Providing a short horn section before mixing can have the effect of smoothing out particle velocity across the exits of the short horns formed by the dividers 129 such that aliasing effects are reduced. For example, a set of small transducers 109, wherein each adjacent pair is spaced a distance d apart from each other (e.g., a straight line that joint a center of the diaphragm of one to the center of the diaphragm of another, and noting that this may not be the mixing distance D referred to above), may have worse aliasing effects than a set of larger transducers 109 (wherein each adjacent pair is also spaced the same distance d apart), due to the additional empty spaces between the smaller transducers 109. FIG. 13 shows two example velocity profiles A and B that may be produced by rings of small and large transducers. In both situations, aliasing occurs at the same frequency, but profile A (of the ring of smaller transducers) has worse aliasing effects than profile B. The short horns created by the dividers 129 have the effect of making the velocity profile of a set of small transducers 109 as illustrated by profile A look more like profile B such that aliasing effects are reduced.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A loudspeaker array, comprising:

a plurality of first transducers to emit sound into a listening area;

one or more second transducers to emit sound into the listening area;

a cabinet to house the plurality of first transducers and the one or more second transducers, the cabinet forming a continuously open circumferential horn including a throat and a mouth, wherein the continuously open circumferential horn flares outward from the throat to the mouth, wherein the plurality of first transducers are coupled to the cabinet in a ring formation around the throat of the continuously open circumferential horn, and wherein the one or more second transducers are integrated within the cabinet and outside the continuously open circumferential horn;

a first set of filters to restrict sound emitted by the plurality of first transducers to a first predefined range of frequencies; and a second set of filters to restrict sound emitted by the one or more second transducers to a second predefined range of frequencies, wherein the first predefined range of frequencies is higher than the second predefined range of frequencies.

2. The loudspeaker array of claim 1, wherein the plurality of first transducers are arranged around the throat of the horn such that a distance between each of the plurality of first transducers is less than a wavelength of the sound at a highest frequency in the first predefined range of frequencies.

3. The loudspeaker array of claim 1, wherein the cabinet is formed of an upper section and a lower section that are coupled together, wherein the upper section and the lower section separately taper inwards such that the cabinet forms an hourglass shape.

4. The loudspeaker array of claim 3, wherein a narrow section or waist of the hourglass shape of the cabinet defines the throat of the continuously open circumferential horn.

5. The loudspeaker array of claim 3, wherein an acute angle of a first taper of the upper section, relative to a plane in which the plurality of first transducers lie, is different from an acute angle of a second taper of the lower section, relative to the plane in which the plurality of first transducers lie.

6. The loudspeaker array of claim 3, wherein a first angle of a first taper of the upper section, relative to a plane in which the plurality of first transducers lie, controls, and a second angle of taper of the lower section, relative to a plane in which the plurality of first transducers lie, controls a spread of sound produced by the plurality of first transducers in a vertical direction.

7. The loudspeaker array of claim 1, wherein the cabinet includes an upper corner and a lower corner at the mouth, and wherein the corners are curved.

8. The loudspeaker array of claim 1, further comprising:

a plurality of dividers, wherein each divider is located between an adjacent pair of transducers in the plurality of first transducers, wherein each of the dividers extends outward from the throat of the continuously open circumferential horn.

9. The loudspeaker array of claim 1, wherein the one or more second transducers is a plurality of second transducers.

10. The loudspeaker array of claim 1, wherein the ring formation of the plurality of first transducers forms a horizontal plane that is perpendicular to an upright stance of the cabinet.

11. The loudspeaker array of claim 10, further comprising:

a beamforming processor to control relative phases and gains of signals used to drive the plurality of first transducers such that the plurality of first transducers generate an acoustic beam pattern along the horizontal plane.

12. A loudspeaker array, comprising:

a plurality of first transducers to emit sound into a listening area;

one or more second transducers to emit sound into the listening area;

a continuously open circumferential horn including a throat and a mouth, wherein the horn flares outward from the throat to the mouth along an upper wall and a lower wall, wherein the plurality of first transducers are coupled to the continuously open circumferential horn in a ring formation around the throat and emit sound toward the mouth, wherein the continuously open circumferential horn reduces a distance at which sound produced by an adjacent pair of transducers in the plurality of first transducers is mixed by providing a uniformly open and unrestricted circumferential cavity for the plurality of first transducers to emit sound into, and wherein the one or more second transducers are above the continuously open circumferential horn;

a first set of filters to restrict sound emitted by the plurality of first transducers to a first predefined range of frequencies; and a second set of filters to restrict sound emitted by the one or more second transducers to a second predefined range of frequencies, wherein the first predefined range of frequencies is different than the second predefined range of frequencies.

13. The loudspeaker array of claim 12, wherein the continuously open circumferential horn is defined by a hyperboloid shape of a speaker cabinet that includes an upper section, a middle section, and a lower section, and wherein the middle section is narrower than the upper section and the lower section.

14. The loudspeaker array of claim 13, wherein the upper section tapers inwards to meet the middle section, and the lower section tapers inwards to meet the middle section.

15. The loudspeaker array of claim 14, wherein the middle section of the hyperboloid shape defines the throat of the continuously open circumferential horn.

16. The loudspeaker array of claim 12, wherein the plurality of first transducers are arranged around the throat of the horn such that a distance between each of the plurality of first transducers is less than a wavelength of the sound at a highest frequency in the first predefined range of frequencies.

17. The loudspeaker array of claim 12, wherein the upper wall includes a first rounded corner proximate to the mouth and opposite the throat of the horn, wherein the first rounded corner of the upper wall is curved upward and away from the throat, wherein the lower wall includes a second rounded corner proximate to the mouth and opposite the throat of the horn, and wherein the second rounded corner of the lower wall is curved downward and away from the throat.

18. The loudspeaker array of claim 12, wherein the ring formation of the plurality of first transducers forms a horizontal plane that is perpendicular to an upright stance of a cabinet.

19. The loudspeaker array of claim 18, further comprising:

a beamformer processor to control relative phases and gains of signals used to drive the plurality of first transducers such that the plurality of first transducers generate an acoustic beam pattern along the horizontal plane.

* * * * *